US006725617B2

(12) United States Patent
Cox

(10) Patent No.: US 6,725,617 B2
(45) Date of Patent: Apr. 27, 2004

(54) WATERPROOF DECK

(75) Inventor: Danny Wayne Cox, College Park, GA (US)

(73) Assignee: G. B. Technologies, LLC, Fairburn, GA (US)

( * ) Notice: Subject to any disclaimer, the term of this patent is extended or adjusted under 35 U.S.C. 154(b) by 0 days.

(21) Appl. No.: 09/963,856

(22) Filed: Sep. 25, 2001

(65) Prior Publication Data

US 2003/0056445 A1 Mar. 27, 2003

(51) Int. Cl.[7] ..... E04B 5/00

(52) U.S. Cl. ..... 52/408; 52/96; 52/97; 52/62; 52/302.6

(58) Field of Search ..... 52/58, 62, 59, 52/60, 61, 302.1, 302.6, 97, 96, 408, 272

(56) References Cited

U.S. PATENT DOCUMENTS

| | | | | | |
|---|---|---|---|---|---|
| 502,009 | A | * | 7/1893 | Neel | 52/97 |
| 1,939,619 | A | | 12/1933 | Cheney | |
| 3,466,827 | A | | 9/1969 | Clem | |
| 4,485,600 | A | * | 12/1984 | Olson | 52/62 |
| 4,706,421 | A | * | 11/1987 | Thompson | 52/96 |
| 4,707,954 | A | * | 11/1987 | Butzen | 52/96 |
| 4,780,997 | A | * | 11/1988 | Taylor et al. | 52/97 |
| 4,780,999 | A | * | 11/1988 | Webb et al. | 52/97 |
| 4,800,689 | A | * | 1/1989 | Lane | 52/96 |
| 5,031,367 | A | * | 7/1991 | Butzen | 52/96 |
| 5,109,641 | A | | 5/1992 | Halan | |
| 5,251,411 | A | * | 10/1993 | Kelley et al. | 52/96 |
| 5,272,846 | A | * | 12/1993 | Kelley et al. | 52/97 |
| 5,303,522 | A | | 4/1994 | Vagedes | |
| 5,383,314 | A | | 1/1995 | Rothberg | |
| 5,414,965 | A | * | 5/1995 | Kelley et al. | 52/96 |
| 5,546,719 | A | * | 8/1996 | Maiers et al. | 52/97 |
| 5,771,643 | A | * | 6/1998 | Parker | 52/302.1 |
| 5,794,388 | A | * | 8/1998 | Jackman | 52/302.1 |
| 5,884,446 | A | | 3/1999 | Hageman | |
| 5,894,697 | A | | 4/1999 | Hunter | |
| 5,927,023 | A | * | 7/1999 | Kittilstad | 52/96 |
| 5,979,133 | A | | 11/1999 | Funkhouser | |
| 6,108,993 | A | | 8/2000 | Hageman | |
| 6,470,638 | B1 | * | 10/2002 | Larson | 52/302.1 |
| 2002/0139068 | A1 | * | 10/2002 | Janesky | 52/302.1 |

FOREIGN PATENT DOCUMENTS

| | | | |
|---|---|---|---|
| JP | 6-17512 | * | 6/1994 |
| JP | 2001-262790 | * | 9/2001 |

* cited by examiner

*Primary Examiner*—Lanna Mai
(74) *Attorney, Agent, or Firm*—Thomas, Kayden, Horstemeyer & Risley

(57) ABSTRACT

A waterproof deck (10) is formed with a subfloor (20) having a waterproof sheet (30) covering the subfloor. A T-bar strip (32) has its stem (34) positioned at the edge of the subfloor, on the waterproof sheet. Protrusions (44) in the stem of the T-bar strip maintain the stem a sufficient distance away from the waterproof sheet and the underlying structure to form water passages at the free edge of the deck, which allows any water seepage through the concrete to drain at the free edge of the deck. Flashing at the sides of the deck shield the T-bar strip from direct contact with the adjacent vertical wall surfaces of the building structure.

5 Claims, 5 Drawing Sheets

WATERPROOF DECK

FIELD OF THE INVENTION

This invention relates to a waterproof deck for a building structure having a subfloor and a concrete floor, whereby water that seeps through the concrete flooring toward the subfloor can be drained from the deck without contacting the subfloor or the adjacent walls of the building structure.

BACKGROUND OF THE INVENTION

Multiple dwellings, such as apartments or condominiums, frequently are built with outdoor decks that extend between a pair of side walls and a back wall, with a free edge opening away from the building structure.

The decks typically are made with a subfloor mounted on supporting joists, with the joists supported by the side walls of the building or by vertical posts. A drip edge strip that is L-shaped in cross section can be placed about the free edge of the subfloor, and a waterproof sheet spread across and covering the subfloor and upper surface of the drip edge. A T-bar strip having its stem is mounted on the drip edge and its cross head forms an exterior wall for the concrete that is poured onto the subfloor to form the concrete floor.

While the above noted arrangement of constructing concrete decks has become common in the art, a problem existed with regard to water seepage through the concrete floor to the waterproof sheet. Water would accumulate on the waterproof sheet and would eventually move into the side walls of the building structure, or into the wooden subfloor, causing structural damage to the building and/or the subfloor.

One of the ways to solve the accumulation of water on the waterproof sheet is to allow the water to escape from the waterproof sheet at the open edge of the deck. Since it is undesirable to form drain holes in the waterproof sheet, some of the waterproof decks have utilized drain passages at the free end of the deck, allowing the water to seep to the free end and flow over the distal edge of the deck. In order to facilitate this arrangement, the waterproof sheet would be extended onto the drip edge strip, and the water could pass between the waterproof sheet and the T-bar strip and over the drip edge strip.

As taught by U.S. Pat. No. 5,546,719, in order to facilitate this drainage arrangement, spacers can be placed under the stem of the T-bar strip and on the waterproof sheet, with the spacers being spaced apart from one another to form drain passages between the T-bar strip and the waterproof sheet. While this arrangement of drain passages has been successful in relieving the accumulation of water on the waterproof sheet of a concrete deck, additional planning and labor is required to build the structure. For example, the spacers typically would be relatively small squares of inert material that are placed by hand on the waterproof sheet, and then the T-bar strip would be placed on the spacers. Preferably, a connector, such as a nail, would be driven through the stem of the T-bar, through the spacer, and through the underlying edge of the waterproof sheet and the drip edge into the subfloor. With this arrangement, it is not unusual that the spacers are improperly placed and/or the connector is not properly driven through the spacers to hold them in place. Also, the process by which the craftsman places the spacers requires additional attention and time, and there are instances when the spacers are not readily available at the job site.

Therefore, it can be seen that it would be desirable to have a waterproof deck structure that does not require spacers to be added to the deck, thereby eliminating the expense, time and inconvenience associated with the use of the spacers.

Another problem associated with waterproof decks is shielding the side walls of the building structure from the water that accumulates on and runs off the deck. Typically, flashing is positioned at the junction between the side wall and the deck so as to channel the water away from the side wall. However, the side walls typically are vulnerable at the intersection of the free edge of the deck with the side wall, where the shape of the deck structure and flashing tends to lose control over the flowing water, particularly wind driven water, that tends to find its way into the building structure.

While flashing can be placed at this intersection, it is difficult to form the flashing so that it corresponds in shape to the end of the T-bar strip, so as to shield the wall of the building structure from the flow of water at or about the end portions of the T-bar strip.

Accordingly, it can be seen that it would be desirable to provide an improved flashing structure for use in combination with a T-bar strip at the ends of the free edge of the waterproof deck.

Therefore, it is an object of this invention to provide an improved waterproof deck for a building structure that is more expedient and less expensive to construct.

Another object of this invention is to provide an improved T-bar strip for use in a waterproof deck of a building structure.

Another object of this invention is to provide an improved T-bar strip for a waterproof deck, wherein the stem of the T-bar strip is formed with protuberances at intervals along its length that are utilized to stand the T-bar strip away from the next adjacent layer of material, such as the waterproof sheet and/or drip edge strip and form drain spaces beneath the stem of the T-bar strip.

Another object of this invention is to provide flashing for use with a T-bar strip, to be placed at the ends of the T-bar strip that join to an adjacent wall, for improving the exclusion of water seepage into the walls.

Other objects, features and advantages of the present invention will become apparent upon reading the following specification, when taken in conjunction with the accompanying drawings.

DETAILED DESCRIPTION

Figure 1:
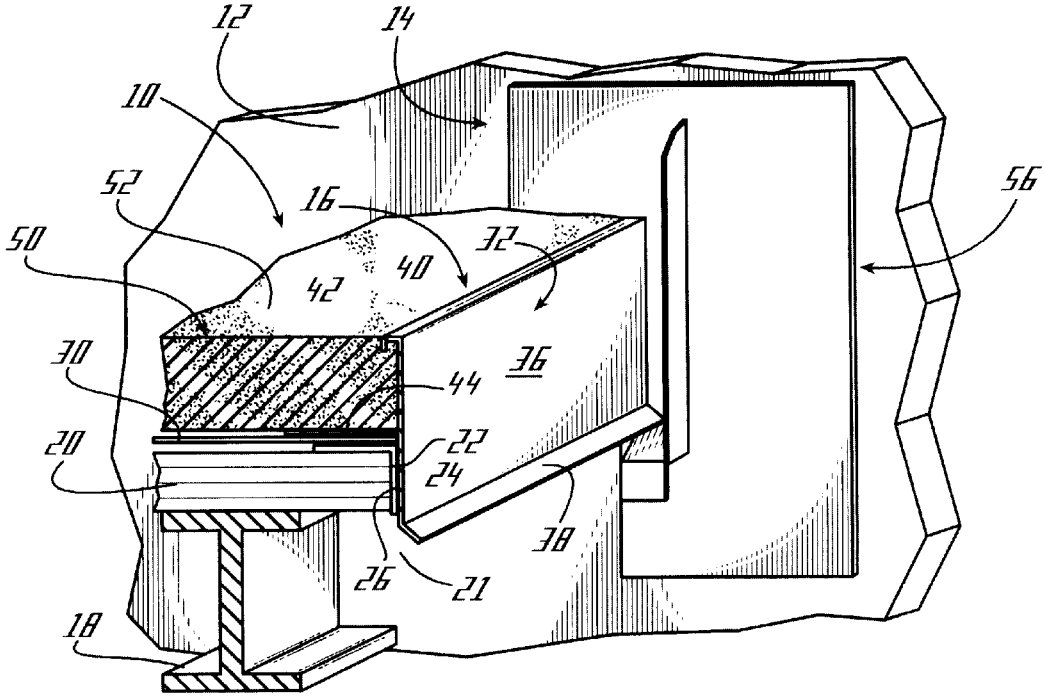
FIG. 1 is a perspective illustration of the free end of a waterproof deck, showing in cross section the structure of the subfloor, concrete floor and the associated elements.

Referring now in more detail to the drawings in which like numerals indicate like parts throughout the several views, FIG. 1 shows a corner of a waterproof deck 10 mounted to a vertical wall 12 of a building structure 14. Typically, the building structure will have three vertical walls in the form of a U-shape, with the waterproof deck spanning the space between the U-shape. The free edge 16 of the deck is open to the outside of the building structure.

The waterproof deck is supported on joists, such as joist 18, that extend from vertical wall 14 to the opposed vertical wall (not shown), or the joists can be supported on vertical posts (not shown) or other conventional support structure. A subfloor 20 is mounted on the joists 18. The subfloor can be formed of various materials, but typically would comprise one inch thick plyboard 20. The plyboard spans the space in the U-shape formed by side walls and back wall of the building structure.

A drip edge strip 22 is placed on the free edge 21 of the subfloor 20. The drip edge strip 22 is L-shaped in cross section and includes a laterally extending run 24 that is placed on the top surface of the subfloor 20, and a vertically extending run 26 that covers the vertical surface of the free edge 21 of the subfloor 20.

An elastomeric waterproof sheet 30 is spread over and covers the upper surface of subfloor 20 and the upper surface of the drip edge strip 22. The elastomeric sheet can be formed of polyethylene film cross-laminated with rubberized asphalt, or other sheet material that is durable in the outdoor environment and which retains its waterproof characteristics.

T-bar

Figure 2A:
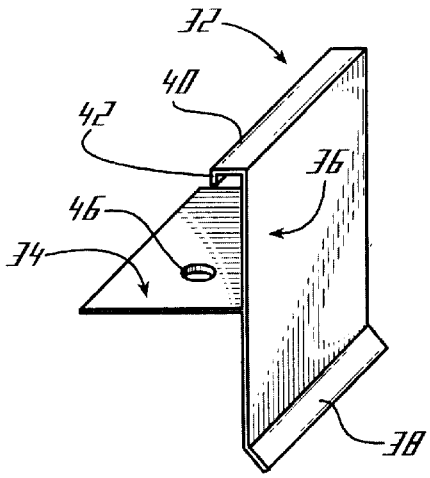
FIGS. 2A and 2B are perspective views of the ends of a T-bar.
Figure 2B:
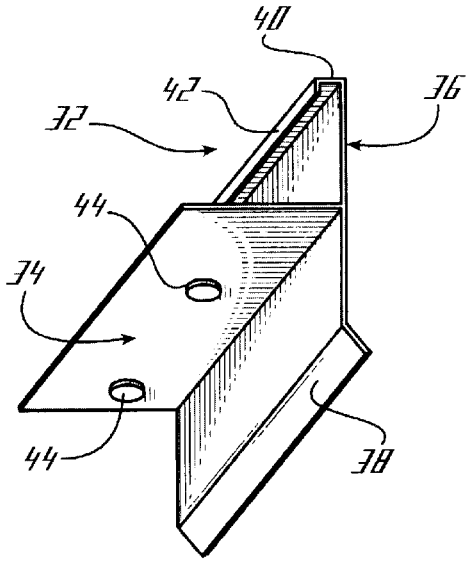

A T-bar strip 32 is placed at the free edge 16 of the waterproof deck 10. As shown in FIGS. 2A and 2B, the T-bar strip 32 includes in cross section a stem 34 and a cross head 36, with the stem and cross head being oriented normal to each other. The lower edge 38 of the cross head 36 is sloped away from stem 34, so as to direct water running down the cross head away from the building structure. The upper end of the cross head 36 is formed with a flange 40 with return 42. The flange 40 and return 42 are sized and shaped so that they function as an anchor when concrete is poured to form the floor of the deck, as will be described later.

Protrusions 44 (FIG. 2B) are formed in stem 34 of T-bar strip 32. Preferably, the protrusions are formed by the application of force on one side of the stem 34, causing a protuberance to be formed on the opposite side thereof. As shown in FIG. 2A, this leaves a recess or indentation 46 on the upper side of the stem. A spaced series of the protrusions/recesses are formed along the length of the stem 34 and face away from the concrete anchor formed by flange 40 and return 42.

The protrusions 44 face in a downward direction and engage the surface next below. In this embodiment of the invention, the surface next below is the waterproof sheet 30, which is flexible. The surface below the waterproof sheet is the laterally extending run 24 of the L-shaped drip edge strip 22. The L-shaped drip edge strip, being made of aluminum, forms a relatively hard surface against which the protrusions 44 of the T-bar strip can bear. Thus, the protrusions 44 maintain a space between the stem of the T-bar strip 32 and the waterproof sheet 30, forming drain spaces along the free edge 16 of the waterproof deck.

The recesses 46 can be used by the installer as locations for driving nails through the stem 34 of the T-bar strip 32, waterproof sheet 30, drip edge strip 22 and subfloor 20, if desired.

The concrete floor 50 is poured onto the waterproof sheet 30, with the upper surface 52 coextensive with the upper surface of the return 40 of the T-bar strip 32. When the concrete is in its liquid form, it fills and occupies the space underneath the flange 40 and behind the return 42 of the T-bar strip. This functions to hold the concrete and the T-bar strip together.

When rain or other water source applies water to the waterproof deck 10, the deck is sloped downwardly toward its free edge the water on the upper surface of the floor 52 tends to drain across the upper portion of the T-bar strip 32, down the outside surface of the cross head 36, then over the angled lower edge 38, where it is allowed to fall downwardly.

In the meantime, if there is any leakage of water through the concrete floor 50 down to the waterproof sheet 30, the water accumulating on the waterproof sheet tends to move toward the free edge 16 of the deck. When the water reaches the stem 34 of the T-bar strip 32, the water can pass between the stem 34 and the waterproof sheet 30 because of the drain space formed by the downwardly extending protrusions 44 that are formed in the stem 34. This allows the water to reach the space between the cross head 36 of the T-bar strip 32 and the L-shaped drip edge strip 22, allowing the water to move downwardly and out from between the drip edge strip and the T-bar strip, without contacting the wooden subfloor 20.

Wall Flashing

Figure 3:
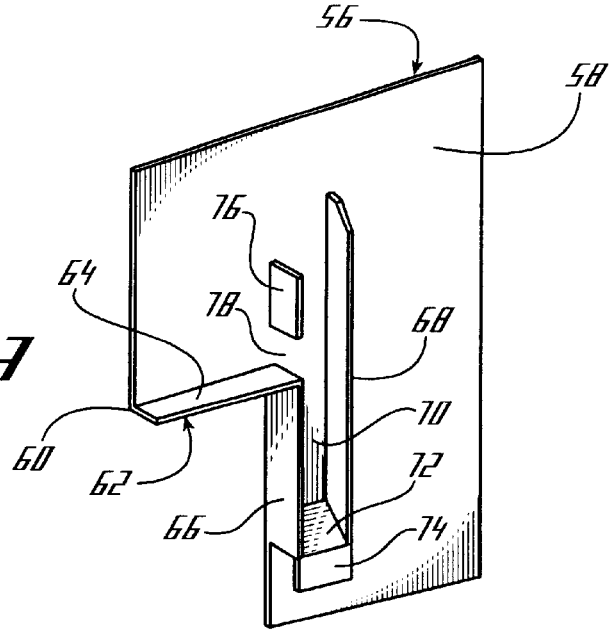
FIG. 3 is a perspective illustration of a wall flashing that is used at the side wall adjacent the free edge of the waterproof deck in combination with the T-bar strip.
Figure 4:
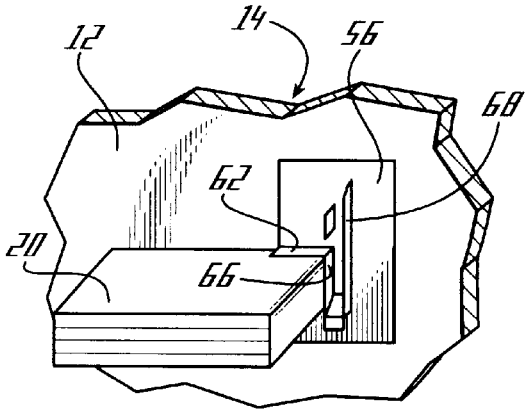
FIGS. 4–8 are perspective illustrations, similar to FIG. 1, but illustrating the procedure in which the waterproof deck is constructed, showing a progressive addition of the parts to the subfloor.
Figure 5:
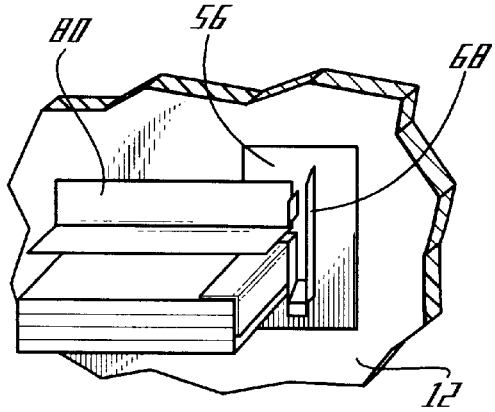

In order to protect the vertical wall 12 of the building structure 14 at the side edge of the deck, adjacent the free edge thereof, a wall flashing is positioned against the vertical wall at the edge of the deck. As shown in FIG. 3, the wall flashing 56 comprises a flat plate 58 that is placed in flat abutment with the vertical wall 12 at the side edge of the deck, and the plate has an L-shaped edge 60 that is shaped to receive the upper and outer surfaces of the free edge of the waterproof deck. An L-shaped flange 62 extends from the L-shaped edge 60 normal to the plate 58. The L-shaped flange 62 has a laterally extending run 64 for resting on the horizontal surface of the deck subfloor and a downwardly or vertically extending run 66 for placement adjacent the vertical edge of the subfloor. A shield 68 is mounted to the plate 58 and is spaced from and extends substantially parallel to the downwardly extending run of the L-shaped flange. The shield and downwardly extending run of the flange form therebetween a drain channel 70. At the lower end of drain channel 70 is a water deflector 72 that guides the water moving down channel 70 away from plate 58, and therefore away from the vertical wall 12 of the building structure 14. A water deflector lip 74 extends downwardly from the water deflector 72, assuring that the water will not travel back toward the plate 58. Positioning tab 76 extends from plate 58 and is coextensive with the vertically extending run 66 of the L-shaped flange 62, with a gap 78 formed between the positioning tab 76 and the L-shaped flange 62.

Assembly of T-bar and Wall Flashing

When the waterproof deck is assembled as illustrated in FIG. 1, the process of assembling the deck is shown in sequence in FIGS. 4–8. The first step (FIG. 4) is to place the wall flashing 56 against the vertical wall 12 of the building structure 14, with the L-shaped flange receiving the upper surface and end surface of the subfloor 20.

Typically, corner flashing, such as L-shaped flashing strip 80 (FIG. 5) is placed at the side edges of the subfloor, with one leg of the flashing against the vertical wall 12 and the other against the subfloor. The flashing 80 is not illustrated in the subsequent figures.

Figure 6:
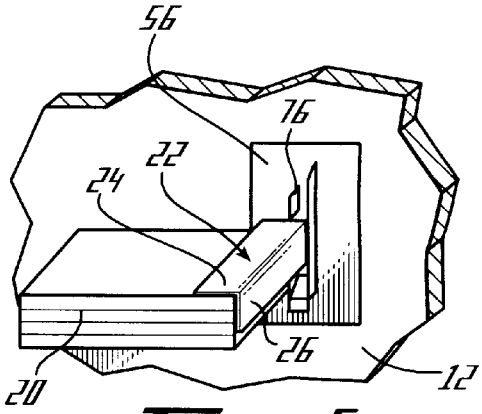

The next step is to apply the L-shaped drip edge strip 22 to the free edge of the subfloor 20 (FIG. 6). The laterally extending run 24 of the drip edge strip 22 is placed over the free edge of the subfloor and its vertically extending run abuts the vertical surface of the subfloor.

Figure 7:
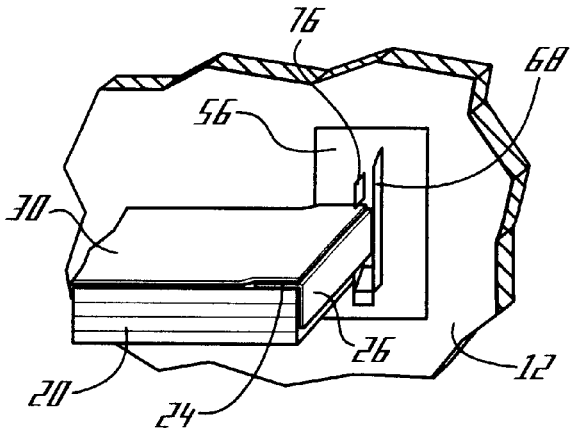

As shown in FIG. 7, the next step is to apply the waterproof sheet 30 to the assembly. The waterproof sheet covers the subfloor from wall to wall, and covers the upper surface L-shaped drip edge strip 22. The side edge of the waterproof sheet also covers the laterally extending run 64 of the L-shaped flange 62 of the wall flashing 56.

Figure 8:
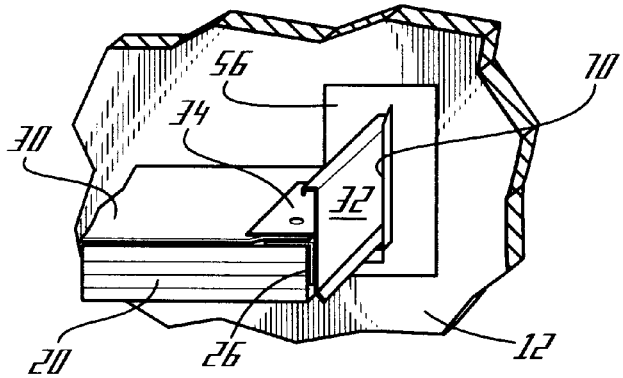

As shown in FIG. 8, the next step is to apply the T-bar strip 32. The stem 34 of the T-bar strip is positioned horizontally and placed on the free edge of the waterproof sheet 30, with the hard surface of the drip edge strip 22 positioned beneath the stem 34 and waterproof sheet. The cross head 32 of the T-bar strip is oriented vertically and is positioned immediately adjacent the vertically extending run 26 of the drip edge strip. Also, the end of the T-bar strip adjacent the flashing 56 is inserted in the drain channel 70, and the stem 34 is placed in the gap 78 between the positioning tab 76 and the laterally extending run 64 of the L-shaped flange 62.

As previously described, the protrusions 44 in the stem of the T-shaped bar strip form drain passages between the stem and the next lower surface, which is the waterproof sheet 30. Therefore, any water draining from the waterproof sheet 30 adjacent the flashing 50 tends to drain downwardly through the drain channel 70 of the flashing.

External Corner Flashing

Figure 10:
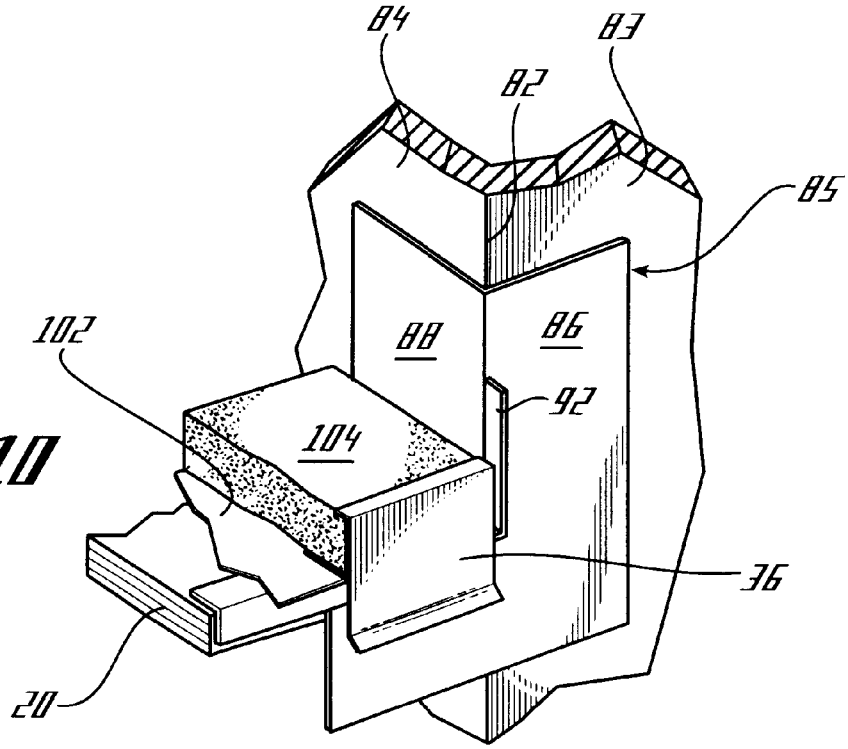
FIG. 10 is a perspective view of a waterproof deck, with parts shown in cross section, illustrating the various parts at the external corner of the building structure.

As shown in FIG. 10, a waterproof deck can be positioned in a space between side walls of a building structure formed in a U-shape so as to confine the deck on three sides, and the corner of the deck can be positioned adjacent an external corner of the building structure. This requires flashing that is different from the flashing illustrated in FIGS. 1 and 3–8.

Figure 9:
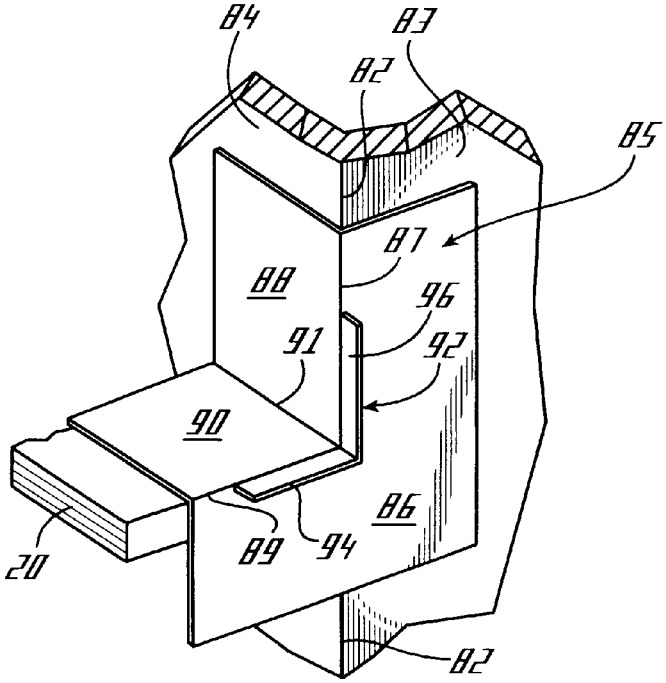
FIG. 9 illustrates an external corner flashing that is used in combination with the T-bar strip, for placement about the external corner of intersecting vertical walls of a building structure, where the side edge of the subfloor abuts one of the vertical walls.

As illustrated in FIGS. 9 and 10, the building structure 80 includes an external corner 82 at the intersection of vertical walls 83 and 84. The external corner flashing 85 is formed so as to correspond in shape with the external corner of the building structure. Flashing 85 includes a first plate 86, a second plate 88, and a third plate 90 (FIG. 9). The plates 86, 88 and 90 are flat, are oriented at right angles with respect to one another, and are joined at L-shaped edges 87 and 89. First plate 86 is arranged to be positioned in abutment with first vertical wall 83 of the building structure 80, second plate 88 is arranged to be positioned in abutment with second vertical wall 84, and third plate 90 is arranged to be positioned in abutment with subfloor 20. L-shaped flange 92 includes a lateral run 94 formed at the intersection of the first and third plates 86 and 90 for forming a drain lip that overhangs the free edge of the subfloor, and a vertical run 96 formed at the intersection of the first and second plates 86 and 88. The lateral run 94 of flange 92 is substantially coextensive with third plate 90, and the vertical run 96 of the L-shaped flange is substantially coextensive with second plate 88.

Figure 11:
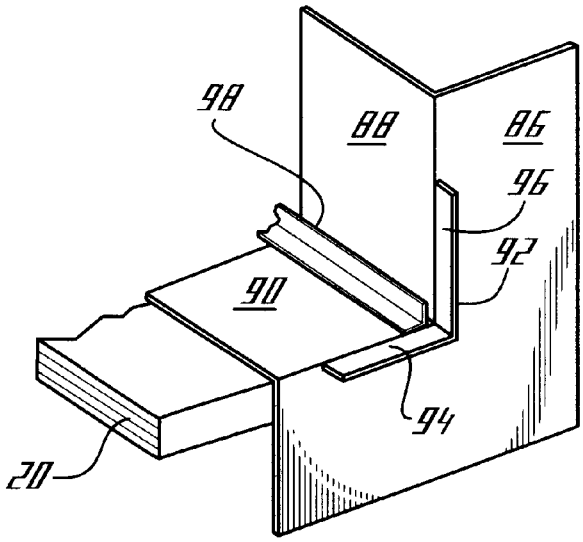
FIGS. 11–14 are perspective illustrations of the manner in which the waterproof deck is constructed, showing a progressive addition of the parts to the subfloor.

As shown in FIG. 11, the waterproof deck will have L-shaped flashing 98 that is positioned at the intersection of the vertical wall 84 with the subfloor 20. The L-shaped flashing 98 overlies the corner 91 where the second and third plates 88 and 90 are joined.

Figure 12:
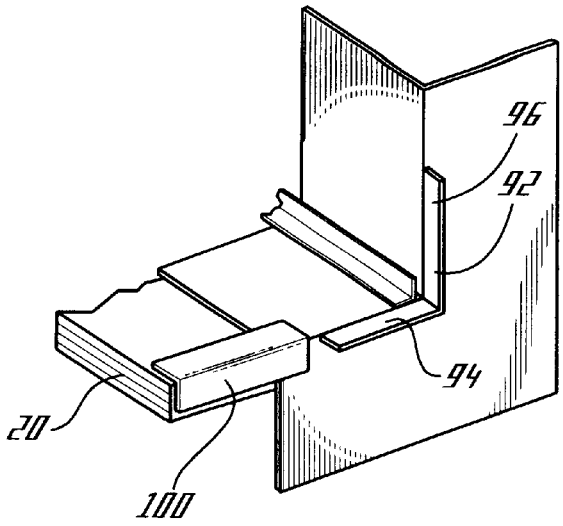

As shown in FIG. 12, a drip edge strip 100 is positioned about the free edge of the subfloor 20, and abuts the L-shaped flange 92.

Figure 13:
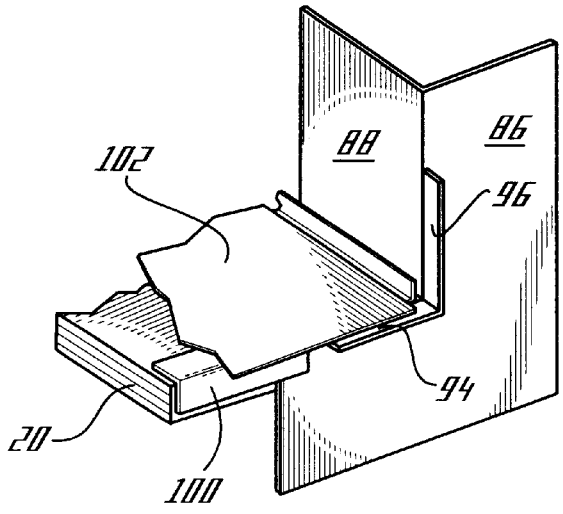

As shown in FIG. 13, the waterproof sheet 102 is applied to and covers the subfloor 20.

Figure 14:
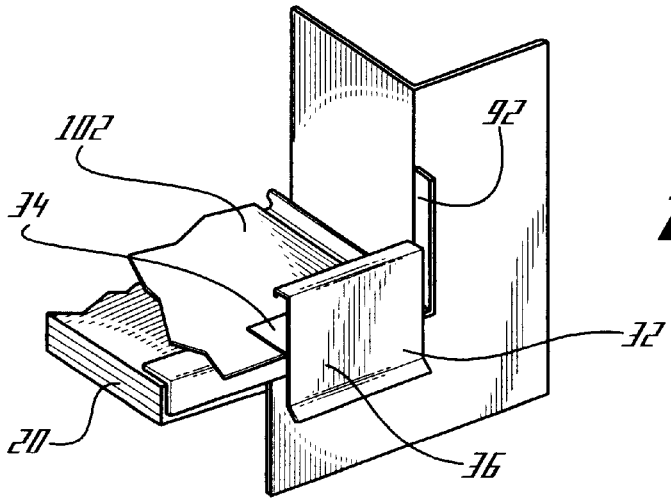

As shown in FIG. 14, the T-bar strip 32 is applied with its stem 34 reaching out over the subfloor 20, and with its cross head 36 in abutment with L-shaped flange 92.

As illustrated in FIG. 10, the concrete floor 104 is poured onto the waterproof sheet 102, behind the cross head 36.

Again, the protrusions 44 (FIG. 2B) form a drain space between the stem 34 of the T-bar strip 32 and the waterproof sheet 102, allowing water to drain off the waterproof sheet from beneath the concrete floor.

In the meantime, the L-shaped flange 92 guides the wind driven water out beyond the first plate 86 and the vertical wall 83, thereby avoiding direct contact of the water with the vertical walls.

Although a preferred embodiment of the invention has been disclosed in detail herein, it will be obvious to those skilled in the art that variations and modifications of the disclosed embodiment can be made without departing from the spirit and scope of the invention as set forth in the following claims.

What is claimed is:

1. A waterproof deck for a building structure, comprising:

a sub floor having a free edge and at least one side edge,

T-bar strip having a stem and a cross head, said stem of said T-bar strip mounted on the free edge of said sub floor and said cross head extending adjacent the free edge of the sub floor, a concrete floor covering said sub floor and extending onto said stem of said T-bar strip, the improvement therein comprising:

a wall flashing including a plate for placement against a vertical wall at the side edge of the deck, said plate including an L-shaped edge, and an L-shaped flange extending from said L-shaped edge and having a laterally extending run for extending along the side edge of the subfloor and extending over the free edge of the subfloor and a downwardly extending run for placement adjacent and extending downwardly from the free edge of the sub floor, a shield mounted on and extending normal to said plate and substantially parallel to said downwardly extending run of said L-shaped flange and forming therebetween a drain channel, said cross head of said T-bar strip extending into said drain channel.

2. The deck of claim 1, and further including a waterproof sheet covering said subfloor and extending beneath said stem of said T-bar strip.

3. The deck of claim 2, and further including:

a drip edge strip formed of elongated L-shaped in cross section material extending along and about said free edge of said sub floor, and said waterproof sheet extends onto said drip edge strip.

4. The deck of claim 3, wherein said stem of said T-bar strip has a series of protrusions formed thereon at intervals along its length, said protrusions facing said drip edge strip and forming a drain space beneath said stem for allowing water to drain off said waterproof sheet beneath said stem of said T-bar strip.

5. A waterproof deck for a building structure, comprising:

a deck subfloor supported adjacent a building structure, said sub floor having at least one side edge adjacent the building structure and a free edge extending away from the building structure that allows water to run off the free edge of the deck, a drip edge strip formed of elongated L-shaped in cross section material extending along and about said free edge, a waterproof sheet covering said subfloor and extending onto said drip edge strip, a T-bar strip formed of elongated T-shaped in cross section material having a stem and a cross head and having said stem of the T-shape oriented horizontally and extending over said waterproof sheet at the free edge of said deck subfloor and having said cross head of the T-shape oriented vertically at the free edge of said subfloor, said stem of said T-bar strip including a series of protrusions integrally formed thereon at intervals along the length of said stem, said protrusions extending toward said waterproof sheet and forming a drain space between said stem of said T-bar and said waterproof sheet, concrete covering said waterproof sheet and said stem of said T-bar strip and forming a concrete floor, whereby water on the concrete floor drains off said concrete floor over said T-bar strip and water on the waterproof sheet drains between the waterproof sheet and the stem of the T-bar strip over said drip edge strip, a wall flashing including:

a plate for placement against a vertical wall at said side edge of the deck, said plate having an L-shaped edge, an L-shaped flange extending from said L-shaped edge normal to said plate and having a laterally extending run for resting on the horizontal surface of the deck subfloor and a downwardly extending run for placement adjacent the edge of said subfloor, a shield mounted to said plate and spaced from and extending substantially parallel to said downwardly extending run of said L-shaped flange and forming there between a drain channel, and said cross head of said T-bar strip extending into said drain channel, so that water draining off the waterproof sheet at the side edge of the deck is shielded from the wall of the building structure.

* * * * *